US010842305B1

(12) United States Patent
Alcolea

(10) Patent No.: US 10,842,305 B1
(45) Date of Patent: Nov. 24, 2020

(54) PACKAGE-SECURING DEVICE

(71) Applicant: German Alcolea, W. Palm Beach, FL (US)

(72) Inventor: German Alcolea, W. Palm Beach, FL (US)

( * ) Notice: Subject to any disclaimer, the term of this patent is extended or adjusted under 35 U.S.C. 154(b) by 0 days.

(21) Appl. No.: 16/666,581

(22) Filed: Oct. 29, 2019

(51) Int. Cl.

| | |
|---|---|
| ***A47G 29/124*** | (2006.01) |
| ***A47G 29/14*** | (2006.01) |
| ***A47G 29/122*** | (2006.01) |
| ***A47G 29/20*** | (2006.01) |
| *G07C 9/21* | (2020.01) |

(52) U.S. Cl.
CPC ..... *A47G 29/124* (2013.01); *A47G 29/1225* (2013.01); *A47G 29/141* (2013.01); *A47G 29/20* (2013.01); *A47G 2029/1226* (2013.01); *G07C 9/21* (2020.01)

(58) Field of Classification Search
CPC ..... A47G 29/1209; A47G 29/1212; A47G 29/1225; A47G 29/124; A47G 29/141; A47G 29/16; A47G 29/20; A47G 2029/1226; A47G 2029/144; A47G 2029/148; G07C 9/21
USPC ..... 232/17, 19, 38, 45, 1 E, 34–36; 340/569
See application file for complete search history.

(56) References Cited

U.S. PATENT DOCUMENTS 1,393,944 A * 10/1921 Chapman ..... A47G 29/1209 232/38
4,785,960 A * 11/1988 Belisle ..... B65D 33/28 220/23.83
D446,011 S 8/2001 Ogilvie
6,426,699 B1 * 7/2002 Porter ..... A47F 10/00 221/2
9,327,887 B2 5/2016 Farentinos
9,596,952 B2 3/2017 Mencel
10,076,204 B1 * 9/2018 Sadeghi ..... A47G 29/141
10,143,320 B1 * 12/2018 Batts ..... A47G 29/124
10,282,951 B1 * 5/2019 Kulick ..... A47G 29/141
2001/0045449 A1 11/2001 Shannon
2005/0061877 A1 * 3/2005 Stevens ..... G07C 9/28 235/385
2006/0186188 A1 * 8/2006 Belanger ..... A47G 29/1216 232/38
2010/0085148 A1 * 4/2010 Nesling ..... G07C 9/00912 340/5.73
2012/0269461 A1 * 10/2012 Proctor ..... G09F 23/00 383/64
2013/0077896 A1 * 3/2013 Wiley ..... A47G 29/20 383/86.2
2013/0147626 A1 * 6/2013 Hammoud ..... A47G 29/1214 340/569

(Continued)

*Primary Examiner* — William L Miller
(74) *Attorney, Agent, or Firm* — Kyle A. Fletcher, Esq.

(57) ABSTRACT

The package-securing device comprises a housing, a plurality of straps, a plurality of latch retainers, a controller, a keypad, one or more batteries, a sound transducer, a camera, a recharger port, and one or more indicators. The housing may couple to a mounting surface at a residence or a business. A package may be securely delivered to the residence or the business by passing the plurality of straps around the package and then locking the latch plates on each of the plurality of straps into the plurality of latch retainers located on the housing. An attempt to remove the package without first entering a secret code may results in a theft response. In some embodiments, the package-securing device may comprise a dye dispenser.

18 Claims, 4 Drawing Sheets

(56) References Cited

U.S. PATENT DOCUMENTS

| | | | | |
|---|---|---|---|---|
| 2016/0060008 | A1* | 3/2016 | Farentinos | E05B 49/002 220/211 |
| 2017/0124510 | A1 | 5/2017 | Caterino | |
| 2017/0127868 | A1* | 5/2017 | Adewuyi | A47G 29/141 |
| 2018/0070753 | A1 | 3/2018 | Eveloff | |
| 2018/0202199 | A1* | 7/2018 | Critz | B65D 33/34 |
| 2018/0296016 | A1 | 10/2018 | Teah | |
| 2019/0133362 | A1* | 5/2019 | Gilligan | A47G 29/141 |
| 2019/0147559 | A1* | 5/2019 | Lee | G06Q 50/32 705/332 |
| 2019/0167025 | A1* | 6/2019 | Cherry | A47G 29/16 |
| 2019/0223644 | A1* | 7/2019 | Hopp | A47G 29/20 |
| 2019/0231104 | A1* | 8/2019 | Dunkelberger | A47G 29/124 |
| 2019/0246828 | A1* | 8/2019 | Miller | A47G 29/20 |
| 2020/0000261 | A1* | 1/2020 | Chambers | A47G 29/141 |
| 2020/0015617 | A1* | 1/2020 | Izquierdo Gonzalez | G06Q 10/0837 |
| 2020/0060460 | A1* | 2/2020 | Farrar | A47G 29/20 |
| 2020/0260897 | A1* | 8/2020 | Loures | E05B 65/52 |

* cited by examiner

PACKAGE-SECURING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of theft deterrence, more specifically, a package-securing device.

SUMMARY OF INVENTION

The package-securing device comprises a housing, a plurality of straps, a plurality of latch retainers, a controller, a keypad, one or more batteries, a sound transducer, a camera, a recharger port, and one or more indicators. The housing may couple to a mounting surface at a residence or a business. A package may be securely delivered to the residence or the business by passing the plurality of straps around the package and then locking the latch plates on each of the plurality of straps into the plurality of latch retainers located on the housing. An attempt to remove the package without first entering a secret code may result in a theft response. In some embodiments, the package-securing device may comprise a dye dispenser.

An object of the invention is to secure a delivered package at a residence or business.

Another object of the invention is to retain the package using a plurality of straps which release the package only after a secret code has been entered correctly.

A further object of the invention is to provide a camera to record attempts to remove the package.

Yet another object of the invention is to provide a dye dispenser as a theft response.

These together with additional objects, features and advantages of the package-securing device will be readily apparent to those of ordinary skill in the art upon reading the following detailed description of the presently preferred, but nonetheless illustrative, embodiments when taken in conjunction with the accompanying drawings.

In this respect, before explaining the current embodiments of the package-securing device in detail, it is to be understood that the package-securing device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the package-securing device.

It is therefore important that the claims be regarded as including such equivalent construction insofar as they do not depart from the spirit and scope of the package-securing device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
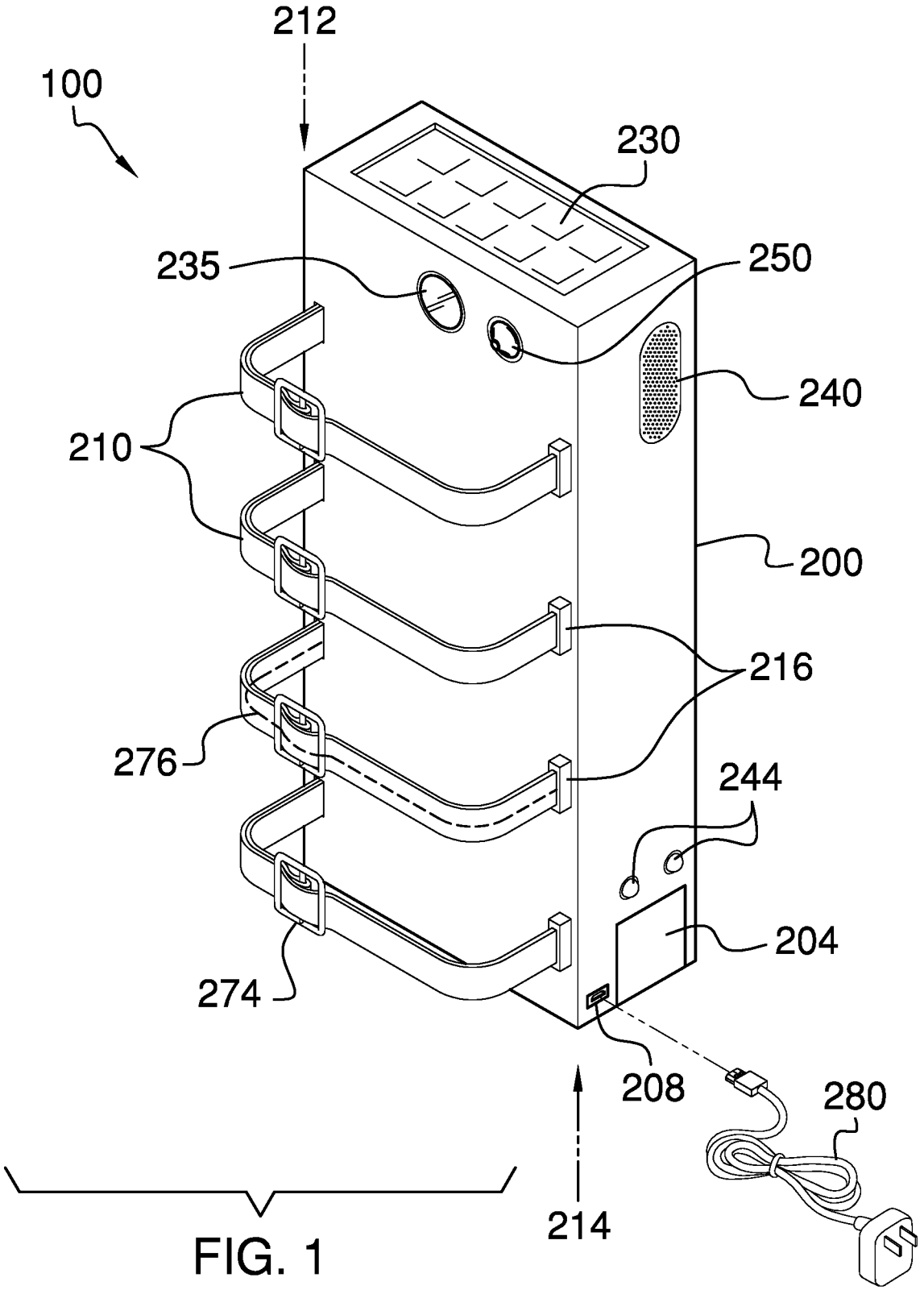
FIG. 1 is a perspective view of an embodiment of the disclosure.
Figure 2:
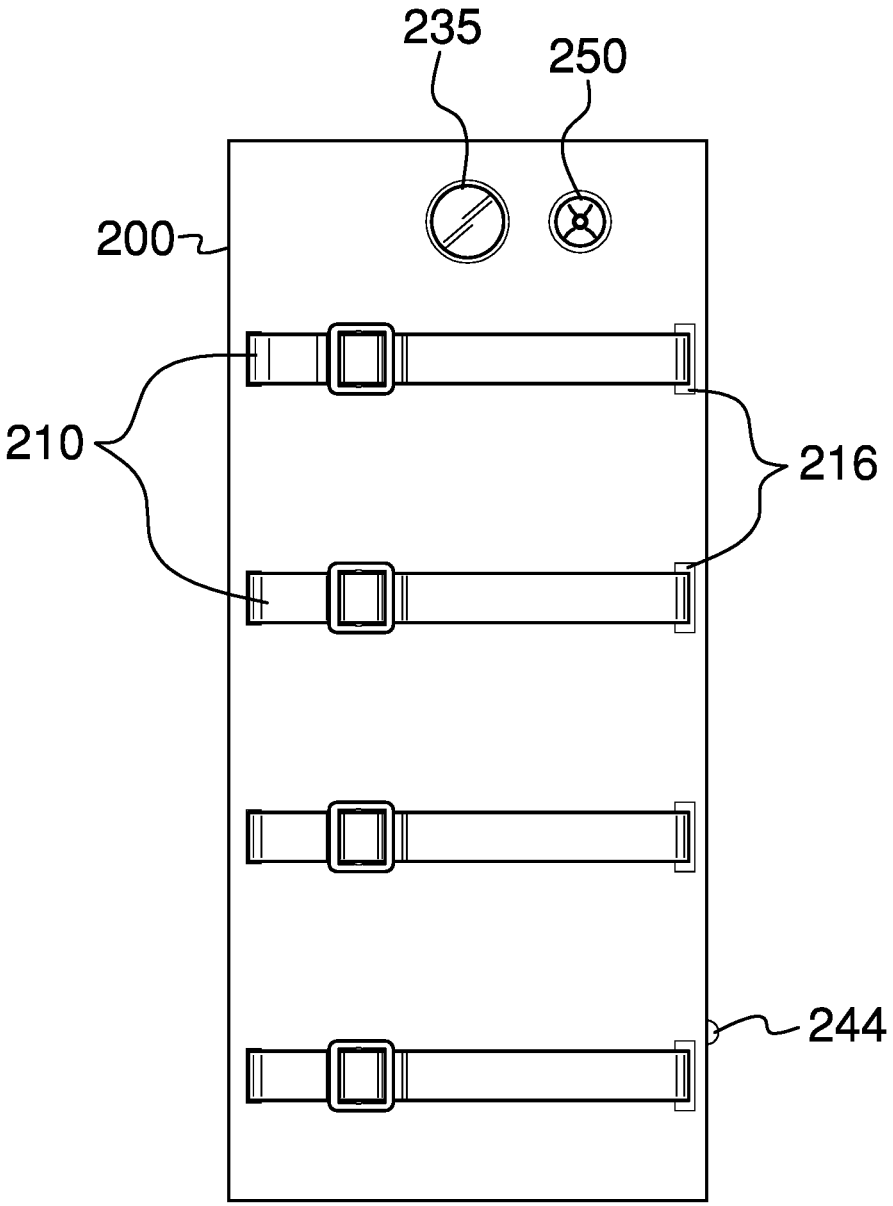
FIG. 2 is a front view of an embodiment of the disclosure.
Figure 3:
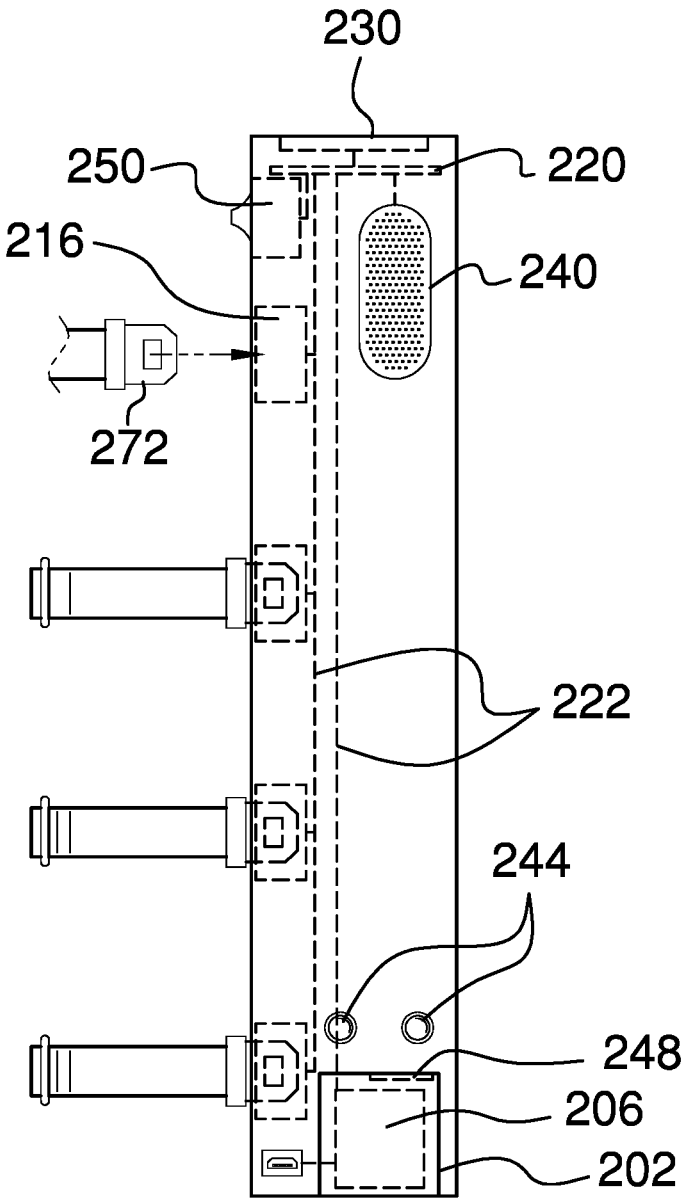
FIG. 3 is a side view of an embodiment of the disclosure.
Figure 4:
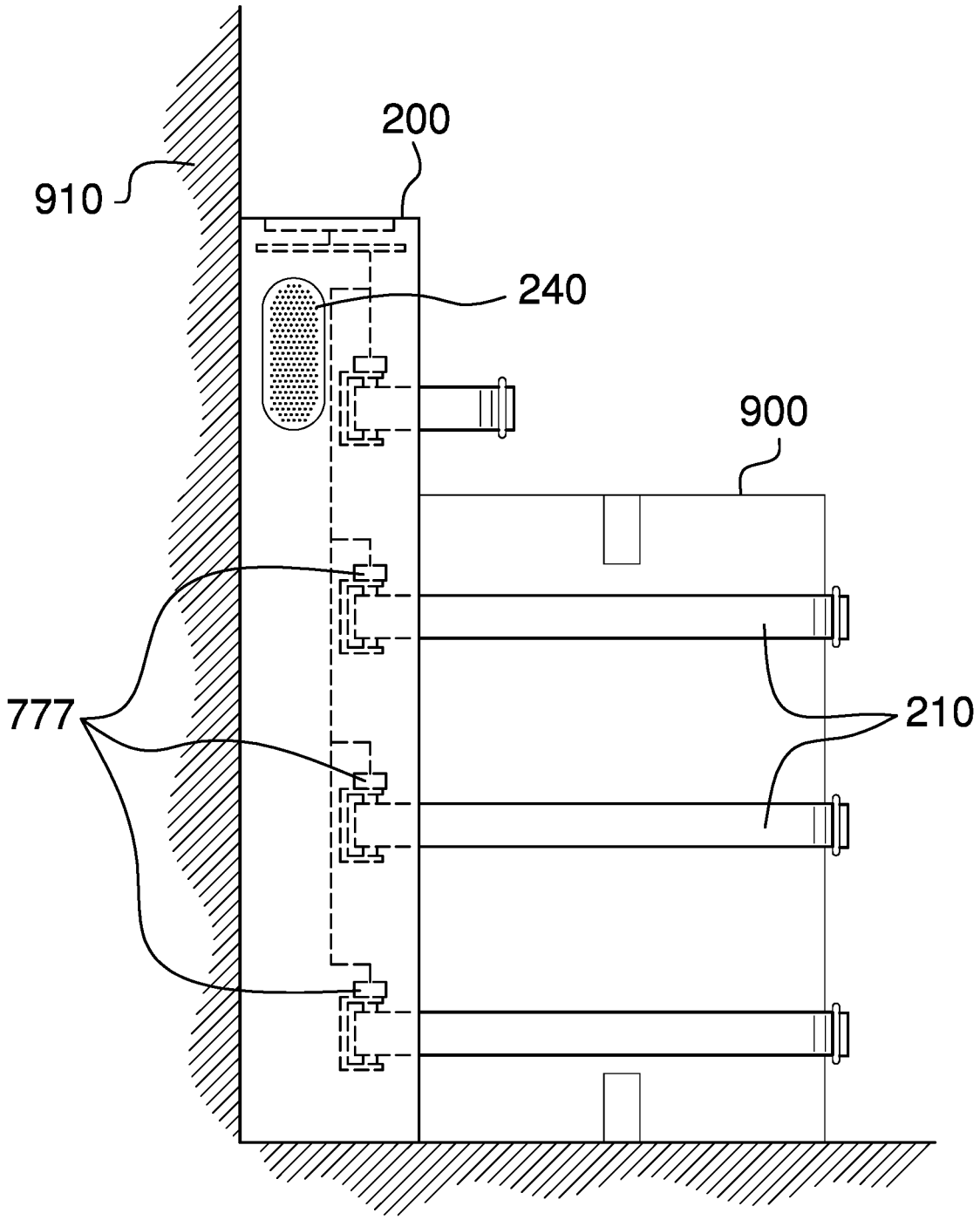
FIG. 4 is an in-use view of an embodiment of the disclosure.

Detailed reference will now be made to a first potential embodiment of the disclosure, which is illustrated in FIGS. 1 through 4.

The package-securing device 100 (hereinafter invention) comprises a housing 200, a plurality of straps 210, a plurality of latch retainers 216, a controller 220, a keypad 230, one or more batteries 206, a sound transducer 240, a camera 235, a recharger port 208, and one or more indicators 244. The housing 200 may couple to a mounting surface 910 at a residence or a business. A package 900 may be securely delivered to the residence or the business by passing the plurality of straps 210 around the package 900 and then locking latch plates 272 on each of the plurality of straps 210 into the plurality of latch retainers 216 located on the housing 200. An attempt to remove the package 900 without first entering a secret code may result in a theft response.

The housing 200 may comprise a battery compartment 202. The housing 200 may be an enclosure for the controller 220, the one or more batteries 206, the keypad 230, the sound transducer 240, and the camera 235. The rear side of the housing 200 may be coupled to the mounting surface 910 to retain the invention 100 in place. The plurality of straps 210 and the plurality of latch retainers 216 may project from the front of the housing 200. The camera 235 may be housed within the housing 200. The camera 235 may be coupled to the front of the housing 200 such that the camera 235 views an area in front of the housing 200. The battery compartment 202 may be located within the housing 200. The one or more batteries 206 may be accessed via a battery compartment door 204.

The plurality of straps 210 may project from a strap side 212 of the front of the housing 200. Each individual strap selected from the plurality of straps 210 may be coupled to the housing 200 at a proximal end of the individual strap and may terminate at a distal end of the individual strap by the latch plate 272. The plurality of straps 210 may be made of a flexible or semi-rigid material. As a non-limiting example, the plurality of straps 210 may be made of nylon. The length of the plurality of straps 210 may be adjusted using a length adjuster 274 located on each of the individual straps.

As a non-limiting example, the plurality of straps 210 may each be affixed to a plurality of locking spools 777 located within the housing 200. The plurality of locking spools 777 would provide tension on the plurality of straps 210, and upon removal of the package 900, the plurality of straps 210 would each retract, and wind upon the plurality of locking spools 777.

The plurality of latch retainers 216 may be located on a lock side 214 of the front of the housing 200. There may be one of the plurality of latch retainers 216 for each of the plurality of straps 210. An individual latch retainer selected from the plurality of latch retainers 216 may receive the latch plate 272 from the individual strap at a corresponding vertical position. Once the latch plate 272 has been inserted into the individual latch retainer, the latch plate 272 may lock into place until electromagnetically released by the controller 220.

Each of the individual straps may comprise a sensing wire 276. The sensing wire 276 may run the length of the individual strap, from proximal end of the individual strap to the latch plate 272. When the individual strap is locked into one of the plurality of latch retainers 216, the sensing wire 276 may complete a cut detection circuit that the controller 220 monitors. The cut detection circuit may extend from the controller 220, to the proximal end of the individual strap via a wiring harness 222, through the sensing wire 276 to the latch plate 272, through the individual latch retainer, and back to the controller 220 via the wiring harness 222. Once continuity through the sensing wire 276 is established by the controller 220, loss of continuity through the sensing wire 276 may indicate an attempted theft of the package 900 by cutting the individual strap unless the secret code has been entered to release the plurality of latch retainers 216.

The controller 220 may control the overall operation of the invention 100. Specifically, the controller 220 may monitor for establishment or loss of continuity through the sensing wires 276 to determine delivery of the package 900 or attempted theft, may monitor the keypad 230 for entering of the secret code, and may activate the plurality of latch retainers 216 to release the latch plates 272 after correct entry of the secret code.

The keypad 230 may be electrically coupled to the controller 220 such that the controller 220 may read key presses on the keypad 230. The keypad 230 may be used to enter the secret code. If the secret code is correctly entered via the keypad 230, the controller 220 may electromagnetically release all of the plurality of latch retainers 216. The keypad 230 may be accessible from the outside of the housing 200. As a non-limiting example, the keypad 230 may be accessible on the top of the housing 200.

The one or more batteries 206 may comprise one or more energy-storage devices. The one or more batteries 206 may be a source of electrical energy to operate the controller 220, the camera 235, the plurality of latch retainers 216, and the sound transducer 240. The one or more batteries 206 may be replaceable or rechargeable.

The sound transducer 240 may convert an electrical signal into an audible sound. As non-limiting examples, the sound transducer 240 may be one or more loudspeakers or one or more piezoelectric transducers. The electrical signal may be provided by the controller 220 in response to a detected theft attempt.

The camera 235 may be an optical instrument that captures images or records video. The images or the video may be stored within memory located on the controller 220. The images or the video may be viewed by transferring the images or the video to a device comprising a display screen. As a non-limiting example, the images or the video may be copied to a memory card 248 and the memory card 248 may be taken to a laptop computer for viewing. In some embodiments, the images or the video may be wirelessly transmitted to another computer for viewing.

The recharger port 208 may be accessible on the housing 200. The recharger port 208 may be directly or indirectly coupled to the one or more batteries 206 such that a recharger 280 plugged into the recharger port 208 may recharge the one or more batteries 206.

The one or more indicators 244 may indicate one or more operational states of the invention 100 via the on/off state or blinking state of the one or more indicators 244. As non-limiting examples, the one or more indicators 244 may indicate that the invention 100 is powered, that the one or more batteries 206 are discharged, that the package 900 is secured by at least one of the plurality of straps 210, that an attempted theft has been detected, that the secret code has been accepted or rejected, or combinations thereof.

In some embodiments, the invention 100 may comprise a dye dispenser 250. The dye dispenser 250 may dispense dye when the dye dispenser 250 is activated by the controller 220. The controller 220 may activate the dye dispenser 250 when an attempted theft is detected, when the secret code is entered incorrectly one or more times, or combinations thereof.

In use, the housing 200 may be coupled to the mounting surface 910 at the residence or the business. The package 900 may be securely delivered to the residence or the business by passing the plurality of straps 210 around the package 900 and then locking the latch plates 272 on each of the plurality of straps 210 into the plurality of latch retainers 216 located on the housing 200. The package 900 may be removed from the invention 100 by entering the secret code to unlock the plurality of latch retainers 216 and release the plurality of straps 210. As the secret code is entered, the camera 235 may record the images or the video to document the person who retrieved the package 900. The images or the video may be viewed on another compute system.

The controller 220 may detect attempted thefts. As non-limiting examples, the controller 220 may determine that the secret code being entered is incorrect or that the sensing wire 276 in one or the plurality of straps 210 has been severed. The theft response may comprise recording the images or the video, producing the audible sound via the sound transducer 240, flashing the one or more indicators 244, dispensing the dye via the dye dispenser 250, or combinations thereof.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, a "camera" is a sensor that converts light into electric signals that encode the spatial orientation of the captured light in a manner that reproduces the images seen by a human eye.

As used in this disclosure, the word "correspond" indicates that a first object is in some manner linked to a second object in a one to one relationship or that one or more properties shared by two or more objects match, agree, or align within acceptable manufacturing tolerances.

As used herein, the words "couple", "couples", "coupled" or "coupling", refer to connecting, either directly or indirectly, and does not necessarily imply a mechanical connection.

As used in this disclosure, a "display" is a surface upon which is presented an image, potentially including, but not limited to, graphic images and text, that is interpretable by an individual viewing the image. When used as a verb, "display" is defined as presenting such an image.

As used in this disclosure, the terms "distal" and "proximal" may be used to describe relative positions. Distal refers to the object, or the end of an object, that is situated away from the point of origin, point of reference, or point of attachment. Proximal refers to the object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used in this disclosure, "flexible" refers to an object or material which will deform when a force is applied to it, which will not return to its original shape when the deforming force is removed, and which may not retain the deformed shape caused by the deforming force.

As used herein, "front" indicates the side of an object that is closest to a forward direction of travel under normal use of the object or the side or part of an object that normally presents itself to view or that is normally used first. "Rear" or "back" refers to the side that is opposite the front.

As used in this disclosure, a "housing" is a rigid casing that encloses and protects one or more devices.

As used in this disclosure, a "laptop computer" is a computer that incorporates into a single housing: 1) a mechanism to provide tactile inputs; 2) a mechanism to provide visual and audio outputs; 3) a mechanism to receive digital or analog inputs from an external mechanical device; and, 4) a mechanism to provide digital or analog outputs to an external mechanical device. The single housing is sized such that the laptop computer can be transported by a single person.

As used in this disclosure, a "latch" is a fastening or locking mechanism. The use of the term latch may imply the insertion of an object into a notch or cavity. The act of latching may involve a linear, pivoting, or rotating motion.

As used herein, "package" refers to any item that is delivered. Non-limiting examples of packages may include rectangular and non-rectangular boxes, parcels, mailing tubes, and padded mailers. Package may also refer to an unwrapped or partially wrapped item that comprises a mailing label or tag. A non-limiting example of such an unwrapped item may be a bicycle with an attached shipping tag.

As used in this disclosure, a "plate" is a flat, rigid object having at least one dimension that is of uniform thickness and is thinner than the other dimensions of the object. Plates often have a rectangular or disk like appearance. Plates may be made of any material, but are commonly made of metal.

As used in this disclosure, a "port" is an electrical termination that is used to connect a first electrical circuit to a second external electrical circuit.

As used in this disclosure, "resilient" or "semi-rigid" refer to an object or material which will deform when a force is applied to it and which will return to its original shape when the deforming force is removed.

As used herein, "rigid" refers to an object or material which is inflexible. If a force is applied to a rigid object the rigid object does not bend or deform unless the force applied reaches the breaking point of the rigid object.

As used in this disclosure, a "screen" is a meshed structure made of wire, yarn, cloth, synthetic materials, or combinations thereof that allows for the free flow of air but prevents larger objects from passing through the meshed structure.

As used in this disclosure, a "transducer" is a device that converts a physical quantity, such as pressure or brightness into an electrical signal or a device that converts an electrical signal into a physical quantity.

As used in this disclosure, "vertical" refers to a direction that is parallel to the local force of gravity. Unless specifically noted in this disclosure, the vertical direction is always perpendicular to horizontal.

Throughout this document references to "wire", "wires", "wired", or "wiring" may describe and/or show a single conductor when, in fact, two conductors may be required to power or control a subsystem; a convention used herein is to not show the common return conductor to which all electrical subsystems are connected—this common return conductor is a continuous electrical path and does not pass through any type of switch or other electrical component other than the possibility of passing through one or more connectors.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A package-securing device comprising:

a housing, a plurality of straps, a plurality of latch retainers, a controller, a keypad, one or more batteries, a sound transducer, a camera, a recharger port, and one or more indicators;

wherein the housing couples to a mounting surface at a residence or a business;

wherein a package is securely delivered to the residence or the business by passing the plurality of straps around the package and then locking latch plates on each of the plurality of straps into the plurality of latch retainers located on the housing;

wherein each of the individual straps comprise a sensing wire operably connected to the controller whereby an attempt to remove the package without first entering a secret code results in a theft response.

2. The package-securing device according to claim 1 wherein the housing comprises a battery compartment;

wherein the housing is an enclosure for the controller, the one or more batteries, the keypad, the sound transducer, and the camera;

wherein a rear side of the housing is coupled to the mounting surface to retain the package-securing device in place;

wherein the plurality of straps and the plurality of latch retainers project from a front of the housing;

wherein the camera is coupled to the front of the housing such that the camera views an area in front of the housing;

wherein the battery compartment is located within the housing;

wherein the one or more batteries are accessed via a battery compartment door.

3. The package-securing device according to claim 2 wherein the plurality of straps project from a strap side of the front of the housing;

wherein each individual strap selected from the plurality of straps is coupled to the housing at a proximal end of the individual strap and terminates at a distal end of the individual strap by the latch plate;

wherein the plurality of straps are made of a flexible or semi-rigid material.

4. The package-securing device according to claim 3 wherein the plurality of straps are made of nylon.

5. The package-securing device according to claim 3 wherein the length of the plurality of straps are adjusted using a length adjuster located on each of the individual straps.

6. The package-securing device according to claim 5 wherein the plurality of latch retainers are located on a lock side of the front of the housing;

wherein there are one of the plurality of latch retainers for each of the plurality of straps;

wherein an individual latch retainer selected from the plurality of latch retainers receives the latch plate from the individual strap at a corresponding vertical position.

7. The package-securing device according to claim 6 wherein once the latch plate has been inserted into the individual latch retainer, the latch plate locks into place until electromagnetically released by the controller.

8. The package-securing device according to claim 7 wherein the sensing wire runs the length of the individual strap, from proximal end of the individual strap to the latch plate;

wherein when the individual strap is locked into one of the plurality of latch retainers, the sensing wire completes a cut detection circuit that the controller monitors;

wherein the cut detection circuit extends from the controller, to the proximal end of the individual strap via a wiring harness, through the sensing wire to the latch plate, through the individual latch retainer, and back to the controller via the wiring harness;

wherein once continuity through the sensing wire is established by the controller, loss of continuity through the sensing wire indicates an attempted theft of the package by cutting the individual strap unless the secret code has been entered to release the plurality of latch retainers.

9. The package-securing device according to claim 8 wherein the controller controls the overall operation of the package-securing device;

wherein the controller monitors for establishment or loss of continuity through the sensing wires to determine delivery of the package or attempted theft, monitors the keypad for entering of the secret code, and activates the plurality of latch retainers to release the latch plates after correct entry of the secret code.

10. The package-securing device according to claim 9 wherein the keypad is electrically coupled to the controller such that the controller reads key presses on the keypad;

wherein the keypad is used to enter the secret code;

wherein if the secret code is correctly entered via the keypad, the controller electromagnetically releases all of the plurality of latch retainers;

wherein the keypad is accessible from the outside of the housing.

11. The package-securing device according to claim 10 wherein the one or more batteries comprise one or more energy-storage devices;

wherein the one or more batteries are a source of electrical energy to operate the controller, the camera, the plurality of latch retainers, and the sound transducer;

wherein the one or more batteries are replaceable or rechargeable.

12. The package-securing device according to claim 11 wherein the sound transducer converts an electrical signal into an audible sound.

13. The package-securing device according to claim 12 wherein the sound transducer is one or more loudspeakers or one or more piezoelectric transducers;

wherein the electrical signal is provided by the controller in response to a detected theft attempt.

14. The package-securing device according to claim 13 wherein the camera is an optical instrument that captures images or records video;

wherein the images or the video are stored within memory located on the controller;

wherein the images or the video are viewed by transferring the images or the video to a device comprising a display screen.

15. The package-securing device according to claim 14 wherein the recharger port is accessible on the housing;

wherein the recharger port is directly or indirectly coupled to the one or more batteries such that a recharger plugged into the recharger port recharge the one or more batteries.

16. The package-securing device according to claim 15 wherein the one or more indicators indicate one or more operational states of the package-securing device via a on/off state or blinking state of the one or more indicators.

17. The package-securing device according to claim 16 wherein the one or more indicators indicate that the package-securing device is powered, that the one or more batteries are discharged, that the package is secured by at least one of the plurality of straps, that an attempted theft has been detected, that the secret code has been accepted or rejected, or combinations thereof.

18. The package-securing device according to claim 17 wherein the package-securing device comprises a dye dispenser;

wherein the dye dispenser dispenses dye when the dye dispenser is activated by the controller;

wherein the controller activates the dye dispenser when an attempted theft is detected, when the secret code is entered incorrectly one or more times, or combinations thereof.

* * * * *